US006454788B1

(12) United States Patent
Ashton

(10) Patent No.: US 6,454,788 B1
(45) Date of Patent: Sep. 24, 2002

(54) METHOD AND APPARATUS FOR ORAL HYDRATION AND MEDICATION ADMINISTRATION USING A PACIFIER APPARATUS

(76) Inventor: Wesley Scott Ashton, 8549 Blackfoot Ct., Lorton, VA (US) 22079

( * ) Notice: Subject to any disclaimer, the term of this patent is extended or adjusted under 35 U.S.C. 154(b) by 3 days.

(21) Appl. No.: 09/706,874

(22) Filed: Nov. 7, 2000

(51) Int. Cl.[7] ..... A61J 17/00
(52) U.S. Cl. ..... 606/234; 606/236
(58) Field of Search ..... 606/234–236; 604/77; 215/11.1, 11.4

(56) References Cited

U.S. PATENT DOCUMENTS

| | | | | | |
|---|---|---|---|---|---|
| 2,520,773 | A | * | 7/1950 | Muller | 606/234 |
| 2,889,829 | A | | 6/1959 | Tannenbaum et al. | 128/252 |
| 3,426,755 | A | * | 2/1969 | Clegg | |
| 3,610,248 | A | | 10/1971 | Davidson | 128/360 |
| 4,813,933 | A | * | 3/1989 | Turner | 604/79 |
| 4,898,291 | A | * | 2/1990 | Sailors | |
| 4,994,076 | A | * | 2/1991 | Guss | 606/236 |
| 5,049,127 | A | * | 9/1991 | Yen Tsang | 606/236 |
| 5,059,215 | A | * | 10/1991 | Girau | 606/234 |
| 5,078,734 | A | | 1/1992 | Noble | 606/236 |
| 5,123,915 | A | * | 6/1992 | Miller et al. | 606/234 |
| 5,127,903 | A | | 7/1992 | Mailot et al. | 606/77 |
| 5,176,705 | A | | 1/1993 | Noble | 606/236 |
| D335,187 | S | | 4/1993 | Stege | D24/196 |
| 5,300,024 | A | * | 4/1994 | Yang | 606/234 |
| 5,512,047 | A | * | 4/1996 | Dvorak | 606/234 |
| 5,578,004 | A | * | 11/1996 | Liang | 606/236 |
| D377,830 | S | | 2/1997 | Lai | D24/114 |
| 5,601,605 | A | | 2/1997 | Crowe et al. | 606/236 |
| D378,417 | S | | 3/1997 | Panagakos et al. | D24/194 |
| D380,270 | S | | 6/1997 | Rekas | D24/194 |
| D391,642 | S | | 3/1998 | Fountain | D24/194 |
| 6,126,678 | A | * | 10/2000 | Aaltonen et al. | 606/234 |
| 6,139,566 | A | * | 10/2000 | Bennett | 606/236 |
| 6,197,044 | B1 | * | 3/2001 | Clayton | 606/236 |

OTHER PUBLICATIONS

Medela Catalog, pp. 32–35, 1997.

Shevlov, S.P. (Ed): Caring for Your Baby and Young Child: Birth to Age 5. Bantam Books, New York, May 1991, pp. 491–493.

Shevlov, S.P. (Ed): Caring for Your Baby and Young Child: Birth to Age 5. Bantam Books, New York, May 1991, pp. 491–493.

* cited by examiner

*Primary Examiner*—David O. Reip
*Assistant Examiner*—Julian W. Woo
(74) *Attorney, Agent, or Firm*—Wesley Scott Ashton

(57) ABSTRACT

An oral pacifier apparatus is disclosed for use by infants and young children to promote soothing oral stimulation and for administering fluids and liquid medications. The pacifier apparatus includes a nipple, a shield, a removable access assembly, and a detachable, refillable reservoir. Furthermore, the nipple includes a linear array of nipple holes which directs fluid flow to physiologic gutters adjacent to the tongue of the user, thereby avoiding stimulating the gag reflex. The method of using the pacifier apparatus to treat dehydration is also disclosed.

17 Claims, 6 Drawing Sheets

METHOD AND APPARATUS FOR ORAL HYDRATION AND MEDICATION ADMINISTRATION USING A PACIFIER APPARATUS

BACKGROUND OF THE INVENTION

1. The Field of the Invention

Pertains generally to the apparatus and method of use of modified infant oral pacification devices for administering liquids and medications to infants and young children. More specifically, the present invention solves the problem of how to gently administer fluids orally in a near continuous or continuous fashion to provide an effective and non-traumatic method and apparatus for treating dehydration.

2. Description of the Prior Art

Gastroenteritis leading to dehydration is a common medical problem faced by infants, young children and their parents. The major goal in treating and preventing dehydration during gastroenteritis is to maintain adequate fluid hydration. The three main methods of administering rehydrating fluids are oral, intravenous and nasogastric methods. Obviously, intravenous and nasogastric methods of administering fluids are invasive, traumatic, require specialized training to administer, and are difficult to provide at home. Oral administration of fluids is the preferred mode of dehydration treatment; however, this mode often fails because it is labor intensive and requires a near continuous administration of fluid. For example, most infants less than 2 years old require about 24 ounces of liquid per day, which equates to a rate of consumption of approximately 1 ounce per hour. During a bout of gastroenteritis, many infants and young children can not tolerate drinking an ounce of fluid at a time without vomiting. In such cases, a slow and steady administration of oral fluids is most successfull when given orally at a rate of approximately 0.5 cc/min to 1.5 cc/min, which is administered in small amounts of 0.5 cc or less at a time, dosed every 1 to 3 minutes, using a syringe or a spoon. Invariately, most patients with gastroenteritis are thirsty, so a typical sick infant or child would eagerly and aggressively gulp down fluid to quench his thirst, only to vomit because of an upset stomach. Unfortunately, many parents allow the sick infant or child to drink ad lib from a bottle or cup which predisposes the sick infant or child to begin a cycle of gulping and vomiting. This self-defeating cycle of gulping and vomiting repeats itself until the sick infant becomes too dehydrated to drink. Furthermore, the care giver frequently becomes frustrated and stressed by this cycle of drinking and vomiting and may even erroneously withhold fluids from the dehydrated infant. Therefore, there is a need for a simple device which is easy to operate and which can help parents administer oral fluids to their children in a controlled fashion to optimize the likelihood of success when treating gastroenteritis at home.

The prior art teaches that pacifiers, made for non-nutritive sucking, may be modified to be used by care givers to administer liquid medications and fluids; however, the prior art devices suffer many shortcomings. U.S. Pat. Nos. 3,610,248 and 5,601,605 typify the prior art fluid administering pacifiers. These devices consist of a hollow nipple, a nipple shield, and a small compressible reservoir. Fluid is placed in the reservoir and the pacifier is placed in the infant's mouth, then the infant either sucks the fluid out of the reservoir as in U.S. Pat. No. 3,610,248, or a care giver may compress the reservoir and force the fluid into the infant's mouth. One shortcoming of these devices is a small reservoir, so the device has to be repeatably removed from the infant's mouth and refilled. Understandably, removing the pacifier device repeatedly from the infant's mouth to refill agitates the infant and may promote irritability and vomiting. Another shortcoming of the prior art device, is that the nipple holes administer fluid preferentially to the back of the throat, which risks activating the gag reflex and induce vomiting, especially when the care giver forces fluid from the reservoir into the infant's mouth. Other patents, to include U.S. Patents Des 377,830, Des 391,642, Des 380,270, and Des 335,187, all show variations of the general prior art design, and all share the disadvantage that the device must be removed from the infant's mouth to refill. In addition, all of the prior art devices, except for U.S. Patent Des 377,830, have no way for the care giver to control the rate of flow of liquids to the infant. Lastly, the prior art devices deliver fluid into the back of the throat, thereby risking gagging the patient, instead of administering fluid preferentially to the natural physiologic gutters found lateral to the tongue in the oral cavity. These natural gutters are designed to drain saliva and fluids from the oral cavity to the pharynx and esophagus and are at a relatively low risk for accidentally triggering vomiting.

Therefore, there is a need for a modified pacifier for administering medications and rehydration fluids that has a conveniently refillable reservoir, and which delivers fluids preferentially towards the physiologic gutters of the oral cavity.

SUMMARY OF THE INVENTION

It is a primary object of the invention to overcome the shortcomings of the prior art infant pacifier devices for use by an operator for administering fluids and medications.

It is a primary object of the invention to provide an infant pacification device for the gentle administration of oral rehydration fluids in a near continuous or continuous fashion.

It is a primary object of the invention to provide an infant pacification device that can be used to administer oral medications.

It is a primary object of the invention to provide a pacification device for infants.

It is a primary object of the invention to provide a pacification device for the gentle administration of fluids and medications utilizing a detachable, conveniently refillable reservoir that minimizes infant agitation.

It is a primary object of the invention to provide a pacification device for the gentle administration of fluids and liquid medications to infants and young children that minimizes the risk of gagging by preferentially directing fluids and liquid medications to the lateral physiologic gutters of the oral cavity.

It is a primary object of the invention to overcome the limitations of the prior art pacifier devices by providing a pacifier apparatus including an attachable access assembly, a nipple portion having an array of terminal ducts with corresponding holes, a shield, and an attachable and readily refillable reservoir.

DESCRIPTION OF THE DRAWINGS OF THE INVENTION

Figure 3A:
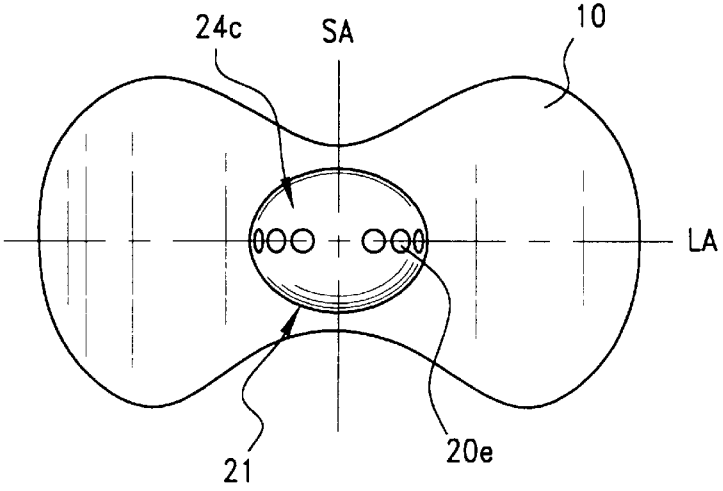

FIG. 3*a* is front view of the pacifier apparatus.

Figure 3B:
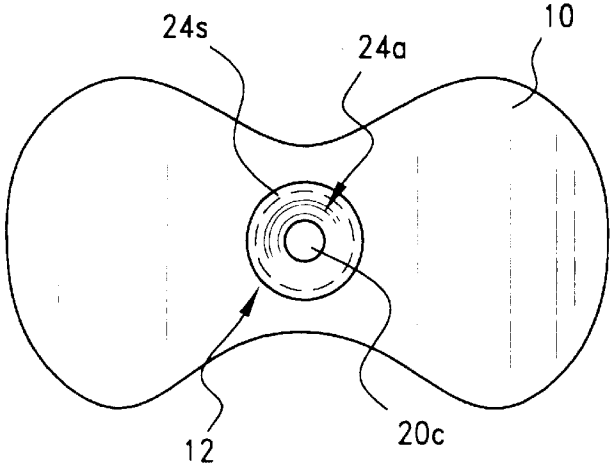

FIG. 3*b* is a rear view of the pacifier apparatus with the access assembly removed.

Figure 4:
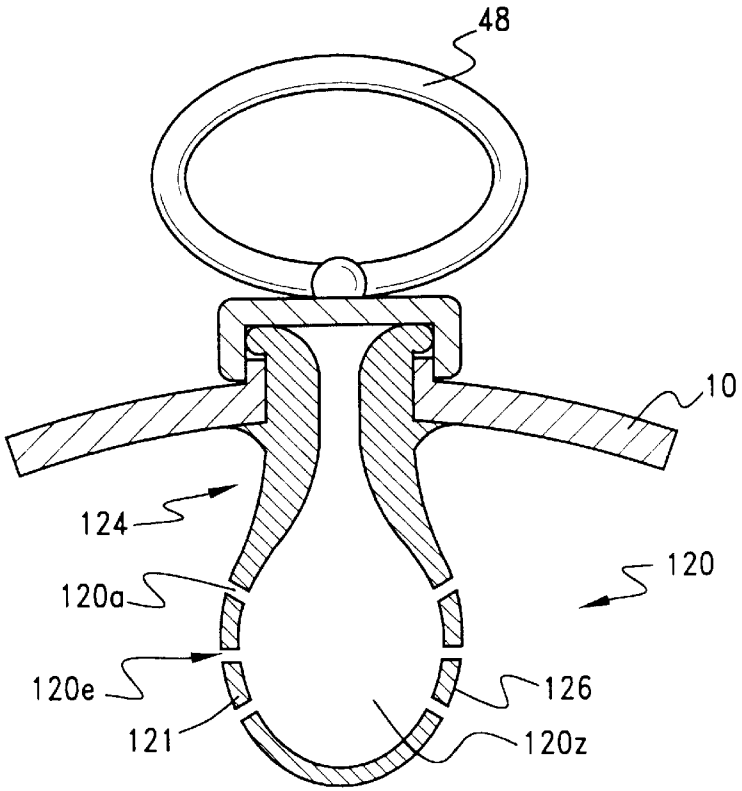

FIG. 4 is a top sectional view of the pacifier apparatus having an alternate embodiment of the nipple portion with access assembly in place.

Figure 5B:
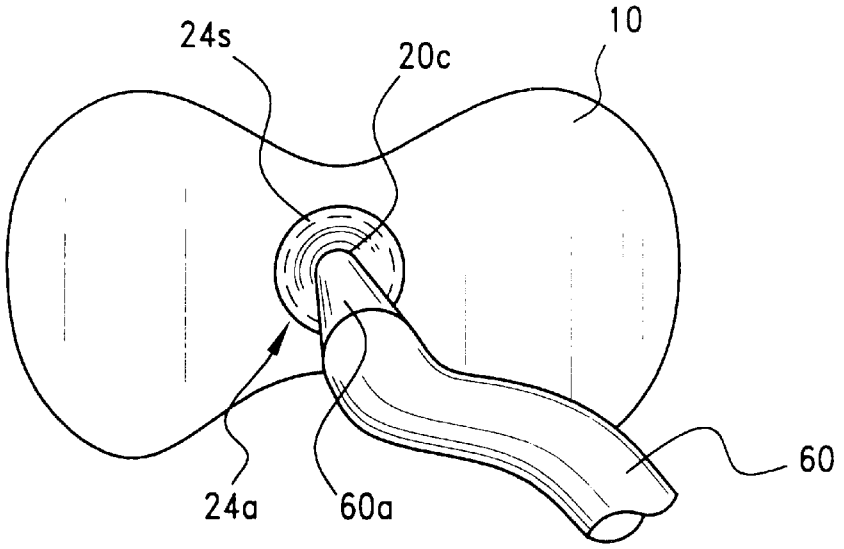
Figure 5A:
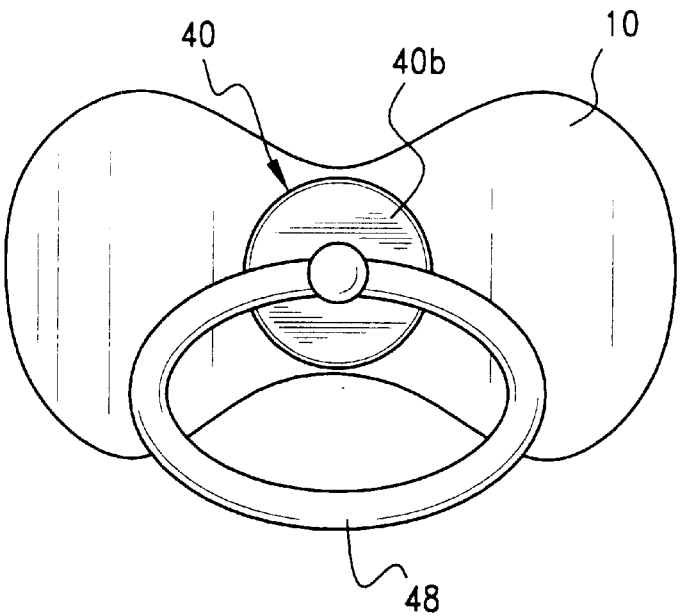

FIG. 5*a* is a rear view of the pacifier apparatus with the access assembly in place.

FIG. 5*b* is a rear view of the pacifier apparatus with the long flexible tube engaging the terminal recess.

Figures 6, 7:
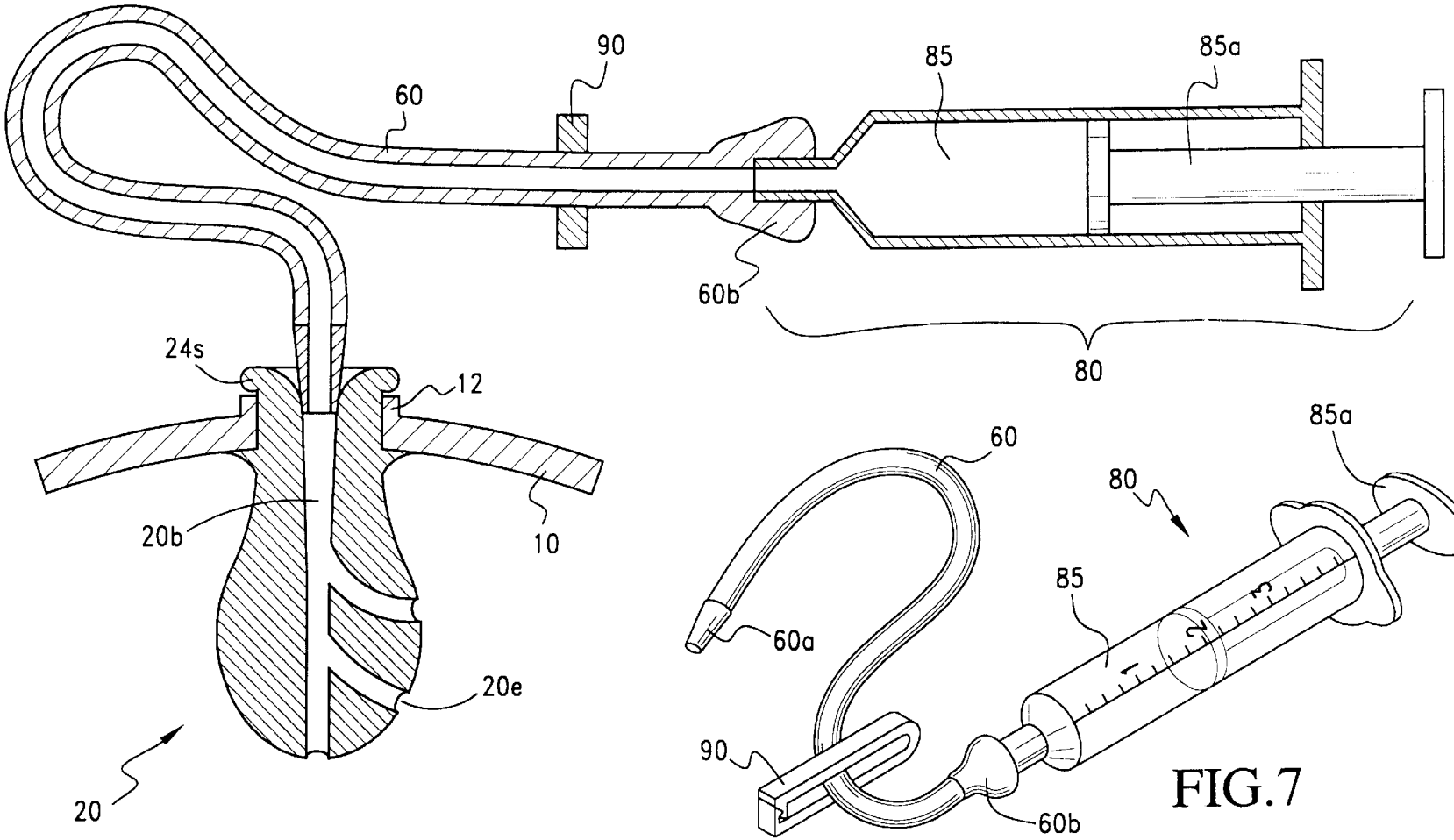

FIG. 6 is a top sectional view of the pacifier apparatus with the detachable reservoir in place.

FIG. 7 is a perspective view of the detachable reservoir.

Figure 8B:
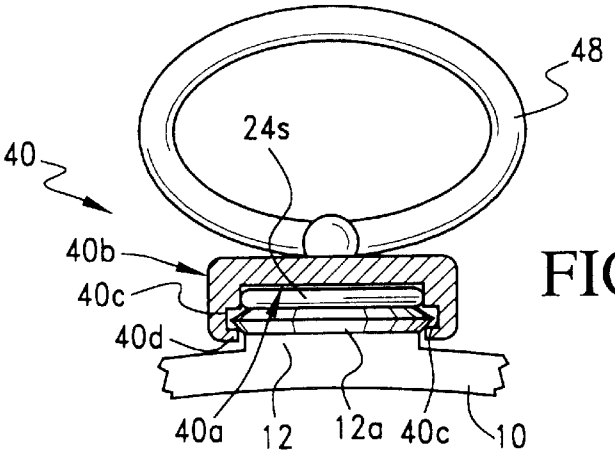
Figure 8A:
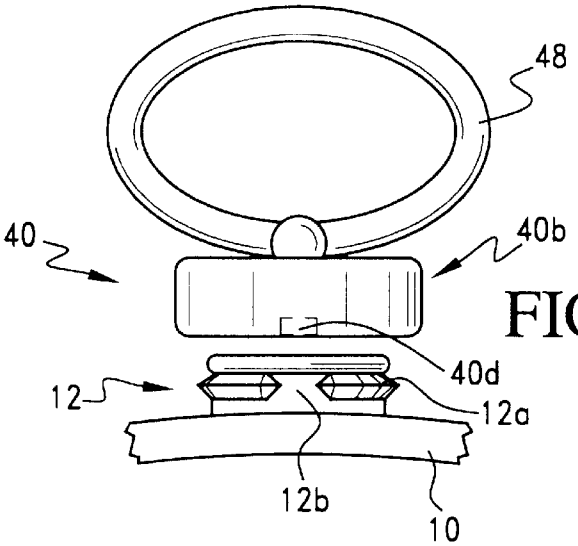

FIG. 8*a* is a top view of the shield and the preferred embodiment of the access assembly.

FIG. 8*b* is a partial sectional view of the shield and the preferred embodiment of the access assembly.

Figure 8C:
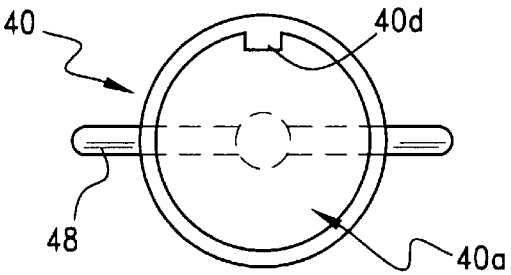

FIG. 8*c* is a bottom view of the preferred embodiment of the access assembly demonstrating the inner portion and the small knob.

Figure 9A:
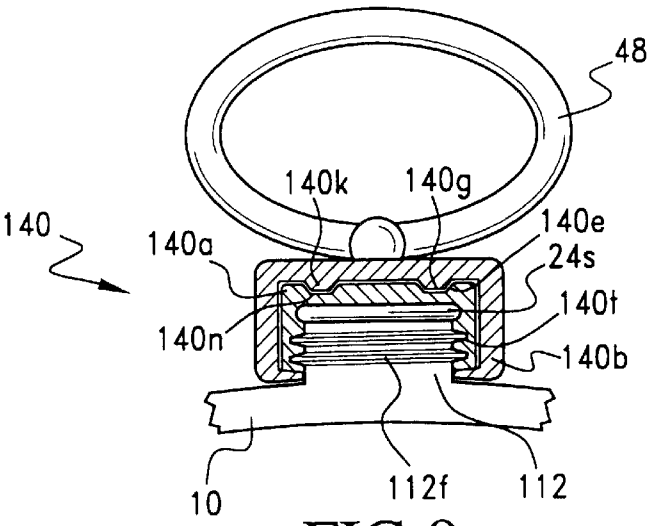

FIG. 9*a* is a partial sectional view of an alternate embodiment of the access assembly.

Figure 9B:
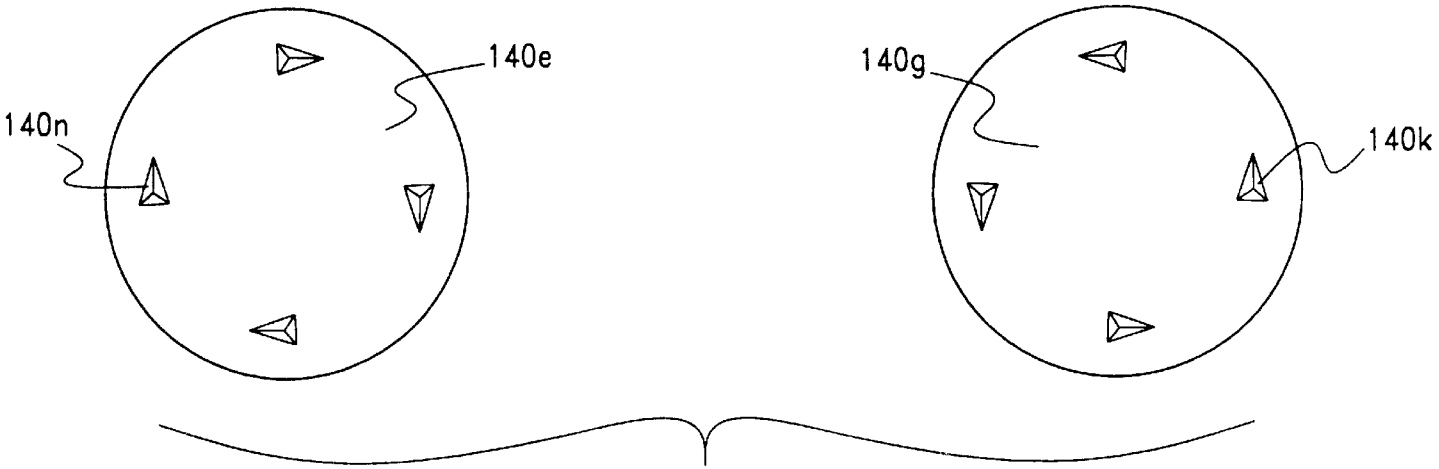

FIG. 9*b* is a view of the engaging surfaces of the inner and outer portions of an alternate embodiment of the access assembly.

Figure 10:
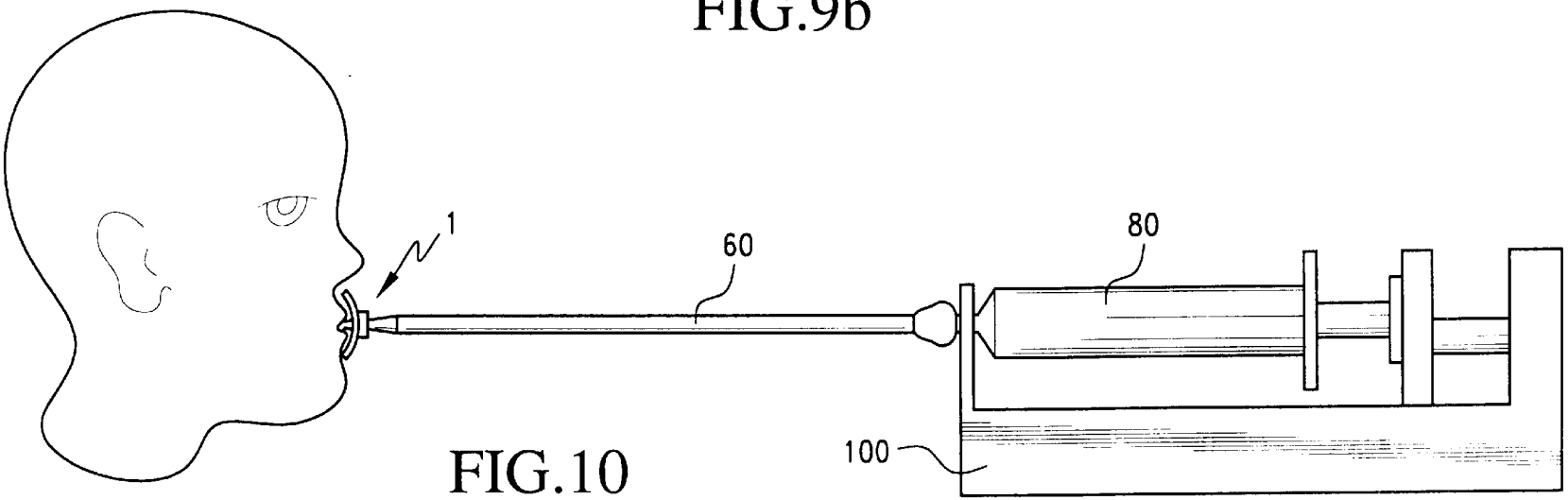

FIG. 10 is a sketch of the pacifier apparatus in use with a syringe pump.

DESCRIPTION OF THE PREFERRED INVENTION AND EMBODIMENTS

Figure 1:
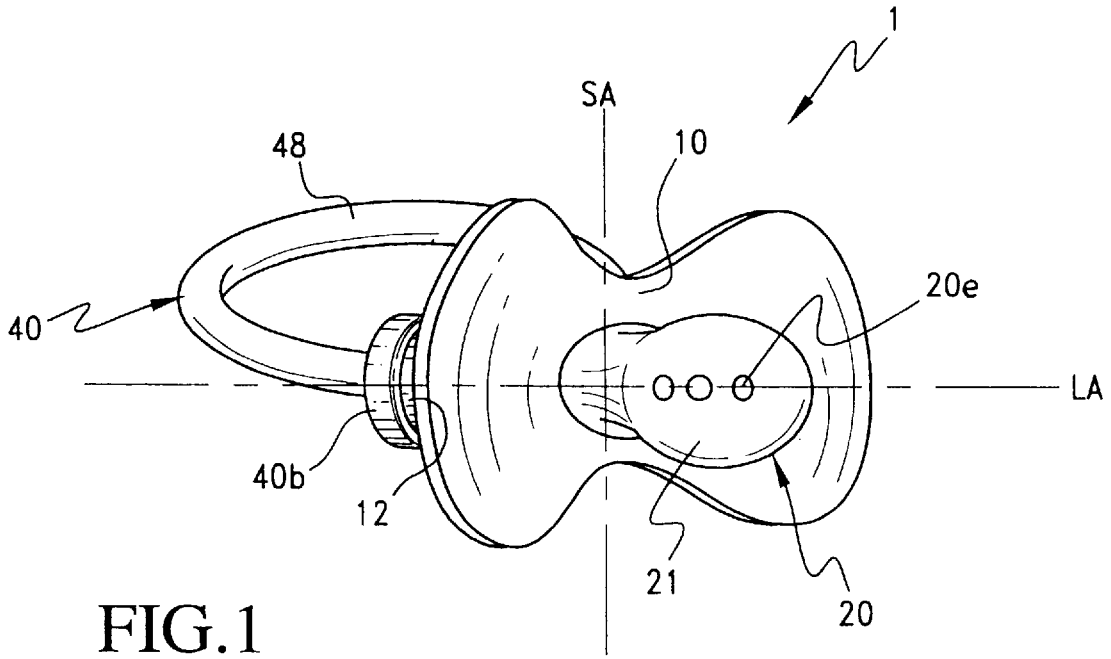
FIG. 1 is a perspective view of the pacifier apparatus with access assembly in place.

Refering now to the drawings wherein like numerals indicate like parts, FIG. 1 illustrates the invention is a pacifier apparatus (1) for infants and very young children having a shield (10) having a concave contour that divides the pacifier (1) into a nipple portion (20) on the concave side and an access assembly (40) on the convex side. The nipple portion (20) includes a nipple (21) that typically has a bulbous shape wherein a rounded tip (22) is contiguous with a neck (24) that connects to the shield (10). The neck (24) has three portions: an exterior portion (24*a*) which is on the same side of the shield (10) as the access assembly (40), a middle portion (24*b*) which engages the walls of aperture (15) in shield (10), and an interior portion (24*c*) which is adjacent to the nipple (21). The bulbous shape of the nipple (21) may be symmetric and elliptical, or the shape may be configured to fit the orthodontic features of an infant's or child's mouth. This orthodontically preferred nipple configuration could be contoured upon manufacture to accommodate a normal child's orthodontic features, or the orthodontic configuration could be made to accommodate an infant or child with a malformed mouth such as is seen with infants and children having a cleft palate or other congenital or acquired oral cavity deformity.

Figure 2:
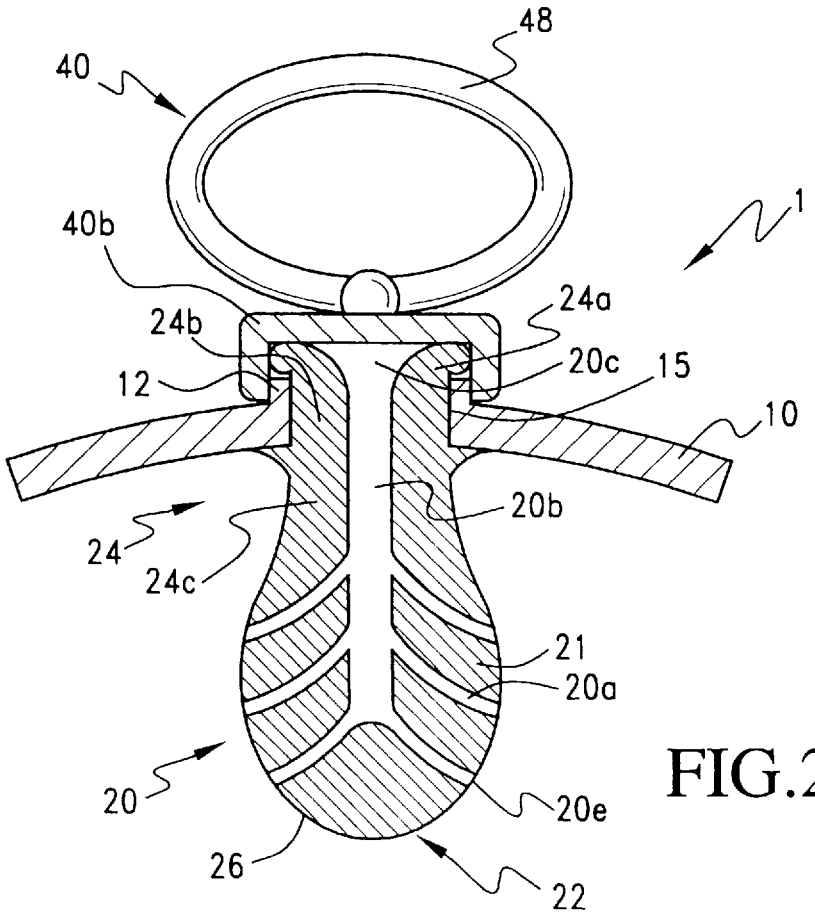
FIG. 2 is a top sectional view of the pacifier apparatus with access assembly in place.

FIG. 2 shows that nipple (21) includes an array of at least one or more terminal ducts (20*a*) coursing through an inner portion of the nipple (21) so as to provide a conduit through which liquids may flow. The array of terminal ducts (20*a*) terminate at holes (20*e*) on the exterior surface (26) of the nipple portion (20) and are disposed along a longitudinal axis (LA) and transverse to a short axis (SA), both axis being defined by the shield (10) as shown in FIG. 3*a*. Furthermore, the number of terminal ducts (20*a*) in the array corresponds to the number of holes (20*e*) on the exterior surface (26) of the nipple (21) of the nipple portion (20). The number of terminal ducts (20*a*) in the array ideally number from 1 to 8 ducts, each terminal duct terminating at a corresponding hole (20*e*). The terminal ducts (20*a*) may be symmetrically distributed about the short axis (SA) and along the longitudinal axis (LA) as shown in FIG. 3*a*, or the terminal ducts (20*a*) may be asymmetrically distributed about the short axis (SA) and along the longitudinal axis (LA) as shown in FIG. 6. It is apparent that any permutation of terminal ducts (20*a*) disposed asymmetrically about the short axis (SA) is permissible (e.g. 1 duct on the right and 7 ducts on the left, three ducts on the right, a single duct on the left, etc . . . ). Furthermore, the pacifier (1) does allow for a single terminal duct (20*a*) terminating at a single hole (20*e*) disposed approximately at the intersection of the short axis (SA) and the longitudinal axis (LA). FIG. 2 shows that the array of at least one or more terminal ducts (20*a*) communicates with a single common duct (20*b*) which is disposed in the neck (24) of nipple portion (20). The common duct (20*b*) further communicates with a terminal recess (20*c*) in the exterior portion (24*a*) of neck (24). Terminal recess (20*c*) opens to the exterior surface (26) of exterior portion (24*a*) thereby forming an access port for receiving a male connector (60*a*) attached to one end of a long flexible tube (60) as shown in FIG. 5*b*. The other end of the long flexible tube (60) is formed with a female connector (60*b*) for removably attaching with the remaining portion of the detachable reservoir (80) as evident from FIG. 6. For convenience, a clamp (90) is disposed anywhere along the flexible tube (60) for clamping the flexible tube (60) to prevent fluid flow. As shown, FIG. 2 illustrates a preferred embodiment for the nipple portion (20), wherein the common duct (20*b*) is located in the neck (24) and the terminal ducts (20*a*) are located in the nipple (21) of the nipple portion (20). However, in an alternate embodiment of the nipple portion (120) as shown in FIG. 4, the common duct extends within both the neck (124) and nipple (121), thereby forming a bulbous cavity (120*z*) in the nipple (121). In this alternate nipple portion embodiment, the nipple (121) could be considered mostly hollow and the terminal ducts (120*a*) are more like short conduits connecting the cavity (120*z*) of nipple (121) to the holes (120*e*) on the surface (126).

Typically, as shown in FIG. 7, the reservoir (80) comprises either a 5 cc, 10 cc or 20 cc syringe having markings for indicating the volume contained therein in either metric cubic centimeters, and/or in multiples of a teaspoon (eg ¼ tsp, or ½ tsp, or 2 tsp multiples and etc). As shown in FIG. 6, the detachable reservoir (80) includes the syringe (85) and the long flexible tube (60). Comprising the syringe (85) which includes plunger (85*a*), the reservoir (80) may be operated manually by a care taker, or the reservoir (80) may be operated by a syringe pump (100) as shown in FIG. 10.

When the pacifier (1) is not used to administer fluids, the reservoir (80) is detached from the terminal recess (20*c*) and the access assembly (40) is put into place over the terminal recess (20*c*) to seal the recess as shown in FIG. 5*a*. The access assembly (40) is made to include an inner portion (40*a*) and an outer portion (40*b*) as shown in FIGS. 8*a*, 8*b* and 8*c*. Furthermore, the exterior portion (24*a*) has a sealing portion (24*s*), shaped as a flange, for being squeezed between the flange (12) and the inner portion (40*a*) of the access assembly (40), thereby effecting an essentially air tight seal when the access assembly is in place so that the infant or child will not suck in volumes of air from the pacifier (1). Preferably, the access assembly (40) is formed as a childproof cap having the inner portion (40*a*) for engaging and securing to the flange (12) of the shield (10). The access assembly (40) also has an outer portion (40*b*) attached to handle (48).

FIGS. 8*a*, 8*b* and 8*c* demonstrate the preferred embodiment for the access assembly (40) wherein the inner portion (40*a*) and the outer portion (40*b*) are integrally formed, and the flange (12) has a terminal ridge (12*a*) having a notch (12*b*). The inner portion (40*a*) has an annular recess (40*c*) and a small knob (40*d*). The shield (10), flange (12), and access assembly (40) are all made of plastic. The shield (10) and flange (12) are integrally formed and made of rigid plastic; however, the integrally formed inner and outer portions (40*a*) and (40*b*) are made of plastic having more resilent and elastic characteristics. In this way, the small knob (40*d*) is dimensioned to a size that permits passage of the small knob (40*d*) through the notch (12*b*) when the access assembly (40) is placed over the flange (12). In addition, the terminal ridge (12*a*) is dimensioned so that it securely and firmly rests in the annular recess (40*c*) when the access assembly (40) is attached to the flange (12). The inner portion (40*a*), being formed of resilient plastic, is dimensioned to snap into place with the small knob (40*d*) passing through the notch (12*b*) and the terminal ridge (12*a*) coming to securely and firmly rest in the annular recess (40*c*). The handle (48) can then be used to rotate the access assembly (40) relative to the flange (12) so that the small knob (40*d*) is not aligned with the notch (12*b*). In this position, the small knob (40*d*) is restrained by the terminal ridge (12*a*), thereby preventing the removal of the access assembly (40). To remove the access assembly (40) from the flange (12), a care giver must align the small knob (40*d*) with the notch (12*b*) and apply pressure to the outer portion (40*b*) to snap the access assembly (40) off the flange (12). It is evident that other knob and notch configurations could be used, including a plurality of knobs and a corresponding plurality of notches.

FIGS. 9*a* and 9*b* demonstrate an alternate embodiment for the access assembly wherein an alternate access assembly (140) effects a child-proof type cap by including an inner portion (140*a*) and the outer portion (140*b*) that are separately formed and arranged coaxially and having engaging surfaces (140*e*) and (140*g*) respectively. Furthermore, the inner portion (140*a*) has threads (140*t*) for removably securing to corrresponding threads (112*t*) of the flange (112). The engaging surface (140*e*) has a series of triangular notches (140*n*) for engaging a series of triangular knobs (140*k*) of engaging surface (140*g*). The triangular notches (140*n*) and the triangular knobs (140*k*) are disposed and arranged so that the triangular knobs (140*k*) easily fixedly engage by friction the triangular notches (140*n*) when a user threadably tightens the access assembly (140) onto the flange (112). However, the triangular knobs (140*k*) and the triangular notches (140*n*) are arranged and disposed so that the inner portion (140*a*) and the outer portion (140*b*) tend to slide over one another when attempting to threadably loosen or disengage the inner and outer portions, (140*a*) and (140*b*) respectively. The inner portion (140*a*) is made of relatively rigid plastic and the outer portion (140*b*) is made from more resilient and flexible plastic. In this way, when a user applies an additional squeezing pressure to the outer portion (140*b*) the triangular knobs (140*k*) are sufficiently forced to fixedly engage by increased friction the triangular notches (140*n*) so as to effect the rotation of both the inner portion (140*a*) and outer portion (140*b*) as a unit, thereby permitting the removal of the access assembly (140) from the flange (112). It is noted that it is within the scope of the invention to utilize other forms of child-proof type caps instead of the access assembly (40) or the alternate access assembly (140) as described.

In operation, the pacifier apparatus (1) is prepared by the caretaker as follows: in a first step, the caretaker removes the access assembly (40) and attaches the male connector (60*a*) of the reservoir (80) to the annular recess (40*c*) of the exterior portion (24*a*) of the nipple (21). The nipple (21) being made of relatively soft rubber and/or synthetic rubber or synthetic rubber derivatives holds the male reservoir (60*a*), which is made of a more hard and stiff plastic, by frictional and restoring forces resulting from a mild elastic deformability of the annular recess (40*c*) by the male connector (60*a*). In a second step, the caretaker fills the syringe (85) with the desired liquid being either a hydration solution or a liquid medication. To achieve this filling step, the syringe (85) may be temporarily detached from the female connector (60*b*) of the long flexible tube (60), filled, and subsequently reattached to the female connector (60*b*) of the flexible tube (60). In a third step, the caretaker primes the flexible tube (60) and the remaining portion of the pacifier apparatus (1), thereby filling the continous conduit formed between the syringe (85) to the holes (20*e*) with the liquid by pushing on the plunger (85*a*). In a fourth step, the caretaker positions the nipple (21) of the pacifier apparatus (1) into the mouth of the infant or child and allows the infant or child to begin the soothing sucking of the nipple (21). In a fifth step, the caretaker begins to administer the liquid by pushing on the plunger (85*a*). It is noted that the administration of the liquid can be performed by forcing 0.5 cc to 1.5 cc aliqouts through the conduit of the apparatus (1) every minute to effect a near continous administration of fluid. Furthermore, in an alternate fifth step, the caretaker could place the syringe (85) into a syringe pump (100) and program the pump (100) to push the plunger (85*a*) to provide a continous administration of fluid, also averaging a flow of 0.5 cc/min to 1.5 cc/min. It would be obvious to one of ordinary skill that the step of administering the liquid is preferably performed at the average rate of 0.5 cc/min to 1.5 cc/min but that faster or slower rates of administration are possible. For prolonged administration of liquid, an added six step would be to refill the syringe (85). In this sixth step, the cartaker stops liquid flow by claming clamp (90), detaching the syringe (85) from the female connector (60*b*), and then refilling the syringe (85) with the desired liquid. Finally in the sixth step, the caretaker reattaches the syringe (85) to the female connector (60*b*). In a seventh step, the cartaker unclamps clamp (90) and then either manually administers the liquid as in step five or by the pump (100) as in alternate step 5. Subsequently, by repeating steps six and seven, the caretaker can provide the liquid to the infant or child for as long as is needed.

From the foregoing disclosure, it is plain that the present invention comprises an improved infant and child pacification device for administering hydrating fluids and liquid medications conveniently by manual or mechanical means. Furthermore, it will be appreciated by those skilled in the art, that the disclosure is merely illustrative of the general features of the invention and that changes could be made to the embodiments described in the foregoing disclosure without departing from the broad inventive concept thereof. Therefore, it is understood that this invention is not limited to the particular embodiments disclosed, but is intended to cover all obvious modifications such as those directed to the asthetic design, geometry, and/or materials of construction, as being within the scope and spirit of the invention as defined by the appended claims.

The invention claimed is:

1. A pacifier apparatus for promoting soothing oral stimulation and for use by an operator for administering liquids to infants and young children, the apparatus comprising:

a shield having a concave contour defining a concave side and a convex side;

a nipple portion disposed mostly on the concave side of the shield, the nipple portion including a nipple and a neck, with a recess disposed at one end of the neck and at least one terminal duct terminating at a hole on an exterior surface of the nipple portion wherein a common duct is contiguous with the recess and the at least one terminal duct so as to form a continuous conduit for liquid to flow;

an access assembly being removably attached to a flange, the flange being formed on the convex side of the shield, the access assembly including a cap having an outer portion and an inner portion, wherein the inner portion is the portion of the access assembly attachable to the flange; and a detachable reservoir for holding a liquid and adapted for connection to the neck, wherein whenever the pacifier apparatus is in operation to administer liquids the access assembly is detached from the flange and the detachable reservoir is attached to the recess of the neck.

2. The pacifier apparatus of claim 1, wherein the neck of the nipple portion engages a wall of an aperture in the shield.

3. The pacifier apparatus of claim 2, wherein the at least one terminal duct further comprises at least two terminal ducts, each terminal duct terminating at a corresponding hole on the exterior surface of the nipple portion, these at least two terminal ducts being disposed so as to form a linear array along a longitudinal axis thereby orienting the flow of liquid towards a physiologic gutter in the oral cavity of an infant or child.

4. The pacifier apparatus of claim 3, wherein the nipple has either an elliptical shape or an orthodontically contoured shape.

5. The pacifier apparatus of claim 4, wherein the nipple portion is made of rubber.

6. The pacifier apparatus of claim 2, wherein the detachable reservoir further comprises a long flexible tube having a male connector at one end and a female conector at the other end, and a syringe, wherein the male connector is connected to the neck at the recess of the nipple portion when the pacifier apparatus is in operation to administer liquids and the female connector is detachably affixed to the syringe.

7. The pacifier apparatus of claim 6, further comprising a clamp disposed along the flexible tube for clamping the flexible tube to prevent fluid flow.

8. The pacifier apparatus of claim 7, wherein when the detachable reservoir is attached to the recess of the nipple portion, the detachable reservoir is operable by the operator to provide a liquid at a continuous or near continuous rate of flow.

9. The pacifier apparatus of claim 8, wherein the detachable reservoir comprises 5 cc, 10 cc or 20 cc syringe.

10. The pacifier apparatus of claim 8, wherein the detachable reservoir is operable by a pump.

11. The pacifier apparatus of claim 8, wherein the rate of flow averages between 0.5 cc/minute and 1.5 cc/minute.

12. The pacifier apparatus of claim 1, wherein the access assembly further comprises an inner portion, an outer portion, a handle attached to the outer portion, wherein the inner portion is connectable to the flange when the pacifier is not in use for fluid administration and wherein the inner portion and the flange are matingly adapted to effect a childproof-type removable connection.

13. The pacifier apparatus of claim 1, wherein the access assembly further comprises an inner portion, an outer portion, a handle attached to the outer portion, wherein the inner portion is connectable to the flange when the pacifier is not in use for fluid administration and wherein the inner portion and the outer portion are frictionally engaged so that the inner portion and the flange effect a childproof-type removable connection.

14. A method of administering a liquid, the liquid being either an oral rehydration solution or a liquid medication and given orally to an infant or child, wherein the method comprises the steps of:

providing a pacification apparatus comprising a shield having a concave contour defining a concave side and a convex side, a nipple portion disposed mostly on the concave side of the shield, the nipple portion including a nipple and a neck, with a recess disposed at one end of the neck and at least one terminal duct terminating at a hole on an exterior surface of the nipple portion wherein a common duct is contiguous with the recess and the at least one terminal duct so as to form a continuous conduit for liquid to flow, an access assembly being removably attached to a flange, the flange being formed on the convex side of the shield, the access assembly including a cap having an outer portion and an inner portion, wherein the inner portion is the portion of the access assembly attachable to the flange, and a detachable reservoir for holding a liquid and is adapted for connection to the neck, wherein whenever the pacifier apparatus is in operation to administer liquids the access assembly is detached from the flange and the detachable reservoir is attached to the recess of the neck, wherein the pacification apparatus is provided with the access assembly removed and the detachable reservoir connected to the recess of the neck of the nipple portion with the detachable reservoir further comprising a syringe including a plunger, with the syringe attached to a long flexible tube;

detaching the syringe from the long flexibe tube and filling the syringe with the liquid;

reattaching the syringe to the long flexible tube and priming the long flexible tube and the nipple portion with the liquid;

positioning the nipple of the pacification apparatus in the mouth of the infant or child; and activating the plunger of the detachable reservoir to cause the liquid to flow from the detachable reservoir into the nipple and into the mouth of the infant or child.

15. The method of claim 14, wherein the syringe is a 5 cc, 10 cc or 20 cc syringe and the step of activating the plunger is performed so the liquid flows in a continuous or near continuous manner at an average rate of flow of between 0.5 cc/minute and 1.5 cc/minute.

16. The method of claim 14, further comprising a step of refilling the syringe comprising:

detaching the syringe from a female connector of the long flexible tube;

refilling the syringe with more of the liquid; then reattaching the syringe to the female connector of the long flexible tube; and subsequently activating the plunger of the detachable reservoir to cause the liquid to flow from the detachable reservoir into the nipple and into the mouth of the infant or child.

17. A pacifier apparatus as recited in claim 1, wherein the recess is a conical recess.

* * * * *